United States Patent [19]

Catron

[11] 3,978,601

[45] Sept. 7, 1976

[54] DISPLAY FRAME WITH RETRACTABLE GARMENT SUPPORT

[76] Inventor: H. Wayne Catron, Rte. 1, Independence, Va. 24348

[22] Filed: Dec. 22, 1975

[21] Appl. No.: 643,377

[52] U.S. Cl. ..... 40/322; 40/152.1; 223/85; 248/307

[51] Int. Cl.[2] ..... G09F 23/06

[58] Field of Search ..... 40/152, 152.1, 322, 40/154, 152.2, 156–159, 125 H, 125 R, 128, 125 F; 248/290, 304–308, 322; 223/85, 88, 89

[56] References Cited

UNITED STATES PATENTS

| | | | |
|---|---|---|---|
| 2,193,699 | 3/1940 | Sadler | 248/307 |
| 2,710,489 | 6/1955 | Myers | 40/322 |
| 3,357,670 | 12/1967 | Larson | 248/290 |

FOREIGN PATENTS OR APPLICATIONS

| | | | |
|---|---|---|---|
| 438,315 | 3/1912 | France | 40/322 |
| 245,856 | 8/1947 | Switzerland | 40/322 |

*Primary Examiner*—John F. Pitrelli
*Attorney, Agent, or Firm*—Bell, Seltzer, Park & Gibson

[57] ABSTRACT

The garment support is supported for vertical movement on a mounting base adapted to be secured to a wall or like support and the display frame is removably supported on and covers the mounting base. The garment support has at least one garment hanging hook on its lower end which may be maintained in a retracted position with the hook substantially hidden by the display frame or the garment support may be lowered to an extended position below the display frame so that garments may be supported thereon. A spring normally urges the garment support upwardly to retracted position and the garment support may be locked in the lowered position.

8 Claims, 5 Drawing Figures

DISPLAY FRAME WITH RETRACTABLE GARMENT SUPPORT

This invention relates generally to a display frame with retractable garment support and more particularly to such a device which may function as an attractive ornamental or decorative object with the garment support in a retracted and substantially hidden position or the garment support may be lowered to an operative position so that garments may be supported thereon.

Conventional garment hanging supports or hooks are usually unattractive and are usually hidden in closets, behind doors and the like. Because of the unattractive appearance of the conventional types of garment hanging hooks, they are not normally provided on the interior walls of rooms, offices and the like.

With the foregoing in mind, it is an object of the present invention to provide a display frame with retractable garment support which may be position as a decorative object supported on an exposed wall of a room or office with the garment support being substantially hidden by the display frame when not in use or the garment support may be easily extended to support garments thereon.

In accordance with the present invention, the display frame with retractable garment support includes a mounting base adapted to be secured to a wall or like support and a display frame which is removably supported on and covers the mounting base. The garment hanging member is supported for vertical movement between the mounting base and the display frame and includes at least one garment hanging hook on the lower end thereof. Resilient means normally urges the garment hanging member upwardly to retracted position with the hook substantially hidden by the display frame and locking means is provided for maintaining the hook in a lower extended position below the display frame so that garments may be supported thereon.

The display frame may include a decorative plaque, picture or the like and the garment support is normally maintained in retracted position with the hook substantially hidden by the display frame when garments are not be supported thereby. The garment support may be easily lowered to an extended position below the display frame so that garments may be supported thereon. The display frame is supported so that it may be easily removed from the mounting base and display frames containing different decorative or ornamental objects may be substituted therefor.

Other objects and advantages will appear as the description proceeds when taken in connection with the accompanying drawings, in which—

Figure 1:
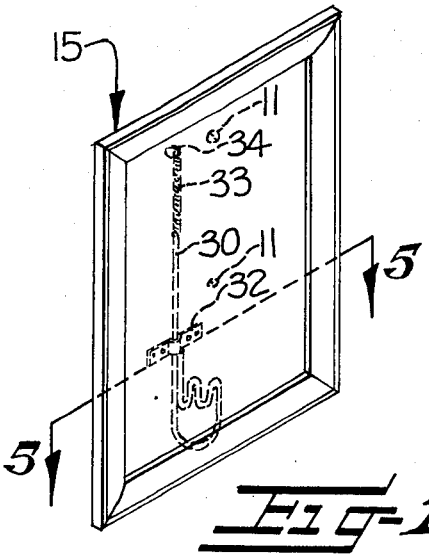
FIG. 1 is an isometric view of the display frame with the garment support in retracted position.
Figure 2:
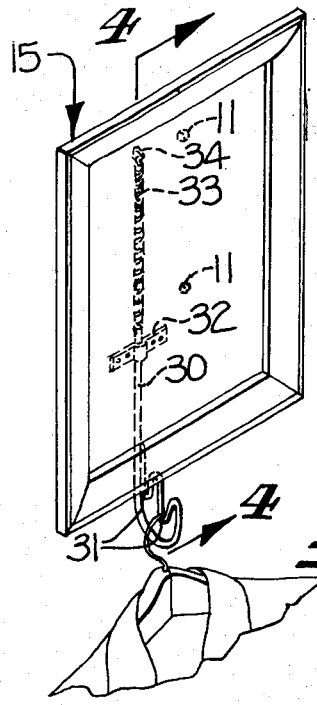
FIG. 2 is a view similar to FIG. 1 but showing the garment support in a lower extended position below the display frame and illustrating the upper portion of one type of garment which may be supported on a coat hanger thereon.

The apparatus of the present invention generally includes a mounting base, broadly indicated at 10, adapted to be secured to a wall or like support by screws 11 (FIG. 4) which penetrate keyhole openings 12 in the medial portion of the base 10. A display frame, broadly indicated at 15, is removably supported on and normally covers the mounting base 10, as illustrated in FIGS. 1 and 2.

Figure 3:
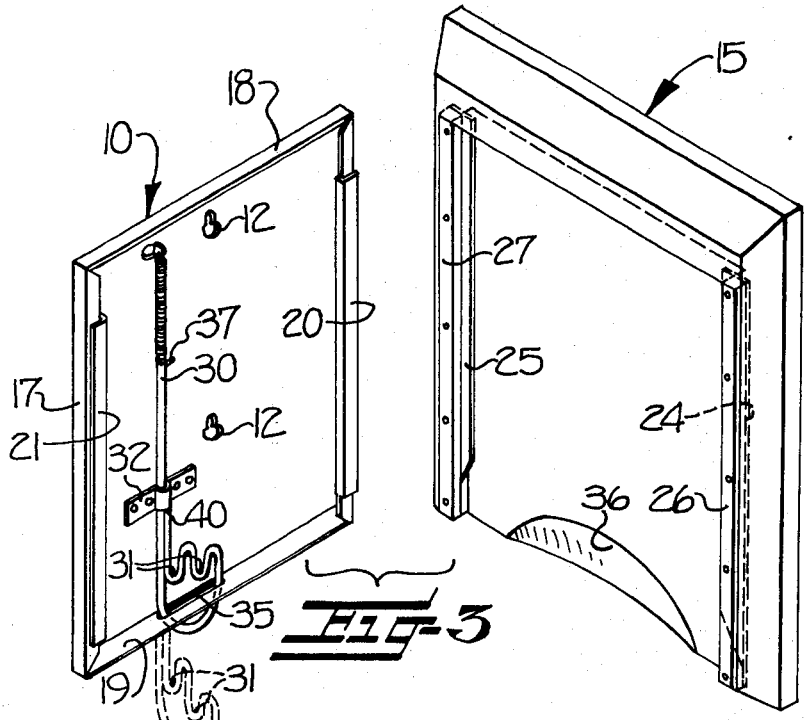
FIG. 3 is an exploded isometric view showing the display frame removed from the mounting base to illustrate the manner in which the garment hanging member is supported for vertical movement between the mounting base and the display frame.
Figure 5:
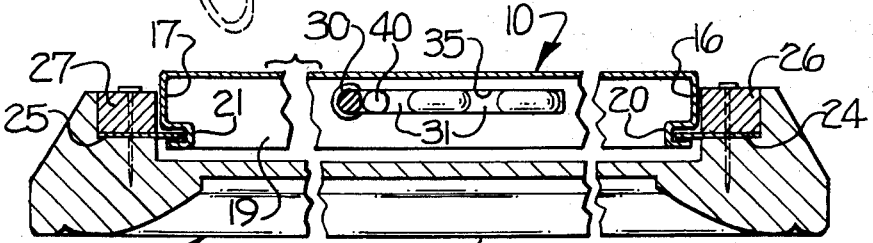
FIG. 5 is an enlarged horizontal sectional view, with parts broken away, taken substantially along the line 5—5 in FIG. 1.

The mounting base 10 is preferably formed of sheet metal and has forwardly extending opposite side walls 16, 17 (FIG 5), a forwardly extending top wall 18 and a forwardly extending lower wall 19 (FIG. 3). The forward edges of the side walls 16, 17 are bent to provide respective grooves or guide channels 20, 21 for purposes to be presently described. Although the mounting base 10 is illustrated as being provided with integrally formed side, top and bottom walls, it is to be understood that the forwardly extending walls could be separately formed to fit around the base as a frame.

Figure 4:
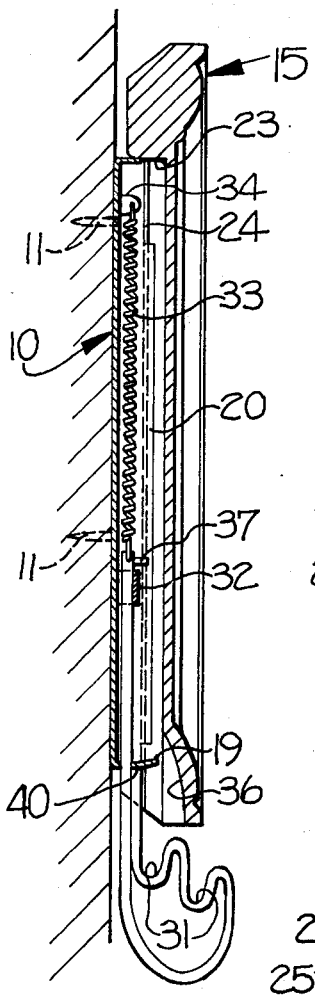
FIG. 4 is an enlarged vertical sectional view taken substantially along the line 4—4 in FIG. 2.

The display frame 15 may be provided with any suitable type of decorative border and may be in the form of a conventional picture frame. The rear surface of the display frame 15 is preferably recessed (FIGS. 3–5) to receive the mounting base 10 therein so that the frame 15 will slide down upon and substantially cover the mounting base 10. The upper edge of the recessed rear portion of the frame 15 provides an upper stop ledge 23 (FIG. 4) and opposite sides of the recess in the rear of the frame 15 are provided with guide plates 24, 25 (FIG. 5) which are held in position by mounting strips 26, 27. The display frame 15 is removably supported on and substantially covers the mounting base 10 by sliding the frame 15 down onto the mounting base 10 so that the guide plates 24, 25 slide into the respective guide channels 20, 21 on the mounting base 10 and the upper stop ledge 23 engages the upper wall 18 of the mounting plate (FIG. 4).

A garment hanging member is supported for vertical movement between the mounting base 10 and the display frame 15 and includes an upper rod-like portion 30 and at least one garment hanging hook on the lower end thereof, illustrated in the drawings as two garment hanging notches 31. The rod-like portion 30 is supported for vertical sliding movement in a guide member or bracket 32 which is suitably secured to the mounting base 10 and resilient means is provided for normally urging the garment hanging member upwardly to a retracted position with the hooked lower end substantially hidden by the display frame. The resilient means comprises a spring 33 which is suitably connected at its upper end to a spring perch 34 on the mounting base and at its lower end to the upper end of the rod-like portion 30. The lower end of the garment hanging member passes through a slot 35 formed in the forwardly extending lower wall 19 and a cut-out 36 is provided in the lower rear surface of the display frame 15. The cut-out 36 provides easy access to the lower end of the garment hanging members so that it may be grasped by the fingers for moving the same from the retracted position shown in FIG. 1 to the extended position shown in FIG. 2.

Stop means, in the form of a stop pin 37 is provided adjacent the upper end of the rod-like portion 30 and is adapted to limit the downward movement of the garment hanging member when the stop pin 37 engages the upper edge of the guide bracket 32. Locking means is operably associated with the garment hanging member for maintaining the lower hooked end in a lower extended position below the display frame 15 when it is desired to support garments thereon. The locking means includes a stop, indicated at 40 in FIG. 4, which is formed by the upper end of the rod from which the garment hanging member is formed. The stop 40 is adapted to engage the lower surface of the lower wall 19 when the hooked lower end is lowered and rotated 90° to a perpendicular position relative to the mounting base 10, as shown in dotted lines in FIG. 3.

When the display frame is supported on a wall or the like, as illustrated in FIG. 1, with the garment hanging member in retracted position, the spring 33 maintains the garment hanging member in retracted position with the lower end positioned in the slot 35 and the stop 40 against the lower edge of the guide bracket 32, as illustrated in solid lines in FIG. 3. In this position, the garment hanging member is substantially hidden by the display frame (FIG. 1) and the device has the appearance of a conventional type decorative picture, plaque or the like. When it is desired to support a garment, the garment hanging member is moved downwardly, against the resistance of the spring 33 and rotated 90° so that the lower hooked end extends perpendicular to the wall. The stop pin 37 limits the amount of downward movement of the garment hanging member while the stop 40 engages the lower surface of the lower wall 19 to maintain the hook in a lower extended position below the display frame so that garments may be supported thereon, as illustrated in FIG. 2. When the garment is removed from the hook, the hooked lower end of the garment hanging member is rotated 90° so that it is parallel with the wall and the spring 33 then raises the garment hanging member upwardly to the solid line positon shown in FIG. 3 where it is again substantially hidden by the display frame.

Although the garment hanging member is illustrated in the drawings as being formed of a single rod or heavy gauge wire which is bent at its lower end to form the garment supporting notches 31, it is to be understood that the garment hanging member can be formed of other types of material and the lower portion may be formed with a small opening for grasping with the fingers to lower the same to the operative position. Also, the lower end of the garment hanging member may be bent slightly toward the observer in FIG. 3 so that it will be spaced away from the wall and will be easier to grasp by the fingers when it is desired to lower the same to the operative position.

The display frame of the present invention provides an attractive decoration which serves to at times conceal a garment hanging member and the garment hanging member may be easily moved to an extended position for use in hanging garments thereon. The display frame is of simple construction and the garment support may be easily positioned in either the retracted or extended position without requiring any special skill.

In the drawings and specification there has been set forth a preferred embodiment of the invention, and although specific terms are employed, they are used in a generic and descriptive sense only and not for purposes of limitation, the scope of the invention being defined in the claims.

That which is claimed is:

1. A display frame with retractable garment support comprising a. a mounting base adapted to be secured to a wall or like support, b. a display frame removably supported on and covering said mounting base, c. a garment hanging member supported for vertical movement between said mounting base and said display frame and including at least one garment hanging hook on the lower end thereof, d. resilient means normally urging said garment hanging member upwardly to retracted position with said hook substantially hidden by said display frame, and e. locking means operably associated with said garment hanging member for maintaining said hook in a lower extended position below said display frame so that garments may be supported thereon, said hanging member being pivotal about a vertical axis whereby it is disposed parallel to siad mounting base in said retracted position and perpendicular to said mounting base in said lower extended position.

2. A display frame according to claim 1 including f. stop means carried by said garment hanging member and limiting the downward vertical movement of said garment hanging member when moved to a lower extended position.

3. A display frame according to claim 1 wherein said mounting base includes opposed side walls extending outwardly from said mounting base, and a vertically extending guide channel on the outer edge of each of said side walls, and wherein said display frame includes vertically extending guide plates carried by opposite sides of the rear side thereof, said guide plates being adapted to be received in said guide channels when said display frame is positioned over said mounting base and lowered onto the same.

4. A display frame according to claim 3 wherein said mounting base includes an upper wall extending outwardly from said mounting base, and wherein said display frame includes an upper stop ledge, said stop ledge being adapted to engage said upper wall and limit downward movement of said display frame on said mounting base.

5. A display frame according to claim 1 wherein said garment hanging member (c) includes an upper rod-like portion, and including a guide member surrounding said rod-like portion and fixed to said mounting base for guiding said garment hanging member for vertical movement.

6. A display frame according to claim 5 wherein said resilient means (d) comprises a spring including a lower end fixed to the upper end of said rod-like portion of said garment hanging member and an upper end fixed to said mounting base and in spaced relationship above the upper end of said rod-like portion of said garment hanging member.

7. A display frame according to claim 5 wherein said stop means (f) comprises a stop pin fixed adjacent the upper end of said rod-like portion of said garment hanging member and being engageable with said guide member for limiting downward movement of said garment hanging member against said resilient means.

8. A display frame according to claim 1 wherein said mounting means includes a lower wall extending outwardly from said mounting base, and wherein said locking means includes an elongate slot formed in said lower wall and extending parallel with said mounting base for receiving said garment hanging hook when said garment hanging member is in a retracted position, and stop means carried by said rod-like portion and being adapted to pass through said elongate slot when said garment hanging member is being moved to a lowered position, said stop means being adapted to engage said lower wall when said garment hanging member is moved to a lowered position and rotated 90° to a position perpendicular to said mounting base.

* * * * *